US008011150B2

(12) United States Patent
Luttrell et al.

(10) Patent No.: US 8,011,150 B2
(45) Date of Patent: Sep. 6, 2011

(54) MODULAR BUILDING ROOF-RIM PARAPET STRUCTURE

(75) Inventors: Michel Luttrell, Hayward, CA (US); Robert J. Simmons, Hayward, CA (US)

(73) Assignee: ConXtech, Inc., Hayward, CA (US)

( * ) Notice: Subject to any disclaimer, the term of this patent is extended or adjusted under 35 U.S.C. 154(b) by 986 days.

(21) Appl. No.: 11/213,113

(22) Filed: Aug. 25, 2005

(65) Prior Publication Data

US 2006/0053703 A1 Mar. 16, 2006

Related U.S. Application Data

(60) Provisional application No. 60/605,729, filed on Aug. 30, 2004.

(51) Int. Cl.
*E04H 12/00* (2006.01)

(52) U.S. Cl. ..... 52/300; 52/58; 52/96; 52/169.14; 52/716.1; D25/55

(58) Field of Classification Search ..... 52/94, 211, 52/300, 57–62, 96, 311.1, 716.1, 716.2, 745.06, 52/745.21, 746.11, 169.14; D25/55
See application file for complete search history.

(56) References Cited

U.S. PATENT DOCUMENTS 2,001,162 A * 5/1935 Strauss ..... 52/289
3,862,531 A * 1/1975 Attaway et al. ..... 52/300
RE28,870 E * 6/1976 Attaway et al. ..... 52/300
4,120,122 A * 10/1978 Bahr ..... 52/58
D346,663 S * 5/1994 McKnight ..... D25/55
5,388,379 A * 2/1995 Lamberti ..... 52/300
5,661,929 A * 9/1997 Ross ..... 52/58
6,837,016 B2 * 1/2005 Simmons et al. ..... 52/655.1
2001/0027625 A1 * 10/2001 Webb et al. ..... 52/96
2005/0235578 A1 * 10/2005 Heidler, Jr. ..... 52/58

OTHER PUBLICATIONS

U.S. Appl. No. 10/818,014.*

* cited by examiner

*Primary Examiner* — William V Gilbert
(74) *Attorney, Agent, or Firm* — Jon M. Dickinson, Esq.; Robert D. Varitz, Esq.

(57) ABSTRACT

Modular, selectively employable building parapet roof-rim structure including (a) gravity-docking reception structure deployed along and adjacent at least a portion of the perimeter of a building roof structure which is adjacent the top of a building frame, and (b) a dockable, modular parapet unit including gravity-docking structure removably and replaceably dockable, under the influence of gravity, with the reception structure to dispose the parapet unit as at least a part of an outwardly visible parapet roof-rim structure associated with the building roof structure. The parapet structure may be associated with moisture-barriering flashing structure which becomes locked into place along the rim of a building roof between inter-engaging components in the parapet structure.

10 Claims, 2 Drawing Sheets

MODULAR BUILDING ROOF-RIM PARAPET STRUCTURE

CROSS REFERENCE TO RELATED APPLICATION

This application claims priority to currently pending, previously filed, U.S. Provisional Patent Application Ser. No. 60/605,729, filed Aug. 30, 2004, for "Architectural Cornice, Parapet and Column-Capping Module". The entire disclosure content of this prior-filed provisional application is hereby incorporated herein by reference.

BACKGROUND AND SUMMARY OF THE INVENTION

In the architecture and outwardly visible design of many plural-story buildings, decorative (and otherwise functional) roof-rimming parapet, or cornice/parapet, structure is often employed. Such structure is normally made to be intentionally ornamental, and may also function as structure which additionally visually obscures, from ground (or other)-level lateral view, building equipment infrastructure, such as heating and air-conditioning, etc. equipment, mounted on the roof top surface, or plane, of a building. Such parapet structure, which is also referred to herein as a parapet roof rim, may also serve conveniently and importantly as a personnel guard wall along a roof's edge/perimeter.

The present invention generally concerns such parapet structure, or parapet roof-rim structure, and more specifically, parapet structure which is designed into the form of modular parapet units which can be pre-designed to have various different decorative profiles and appearances (configurations), and which can quickly, conveniently, easily and changeably, be "hung" and stabilized by gravity adjacent the rim of a building's roof structure to provide all of the parapet functions mentioned above, and more.

In general terms, the modular parapet units which are proposed by the present invention "fit" categorically into elongate, modular configurations which can be characterized as (a) being straight and linear, (b) possessing an inside corner (typically about 90 degrees) configuration, and (c) possessing an outside corner (typically about 270-degrees) configuration. The modular parapet structure of this invention is, of course, and with respect to angular configurations, not confined to the two specific corner configurations just generally mentioned.

As will be seen, in addition to the various conventional parapet functions which are furnished by the modular structure of this invention, also furnished very conveniently by the invention is the opportunity for ready modular pre-design of parapet units of virtually any appropriate outside appearance, which units can be prepared for installation in a building construction. Additionally offered by the present invention is an opportunity for selective changing from time to time of the effective appearance of a building, simply through the easily implemented practice of changing the specific gravity-hung parapet structure per se.

The units of this modular invention, while very appropriately hung and stabilized by gravity, preferably in such a fashion that inwardly and downwardly directed vectors which produce angular moments tend to hold the hung units against the supporting building structure with which they dock, can also be positively locked against inadvertent removal in any one of a number of different, preferably reversible/undoable manners.

As will be seen, one interesting feature of one characteristic embodiment of the invention is that certain interconnecting components of the proposed parapet structure can function to lock between them sheets of moisture-barriering flashing structure to provide excellent weather sealing around and along a building's roof-rim perimeter.

The various features and advantages which are offered and attained by the present invention will now become more fully apparent as the description which follows below is read in conjunction with the accompanying drawings.

DESCRIPTION OF THE DRAWINGS

FIG. 2 also illustrates how implementation and installation of the parapet structure of this invention can function to obscure, beyond certain angular lines of lateral view relative to the horizontal, direct viewing of building equipment structure mounted on the roof of the building illustrated in FIGS. 1 and 2.

FIG. 3 is presented on a slightly larger scale than that employed in FIG. 2.

DETAILED DESCRIPTION OF THE INVENTION

Figure 1:
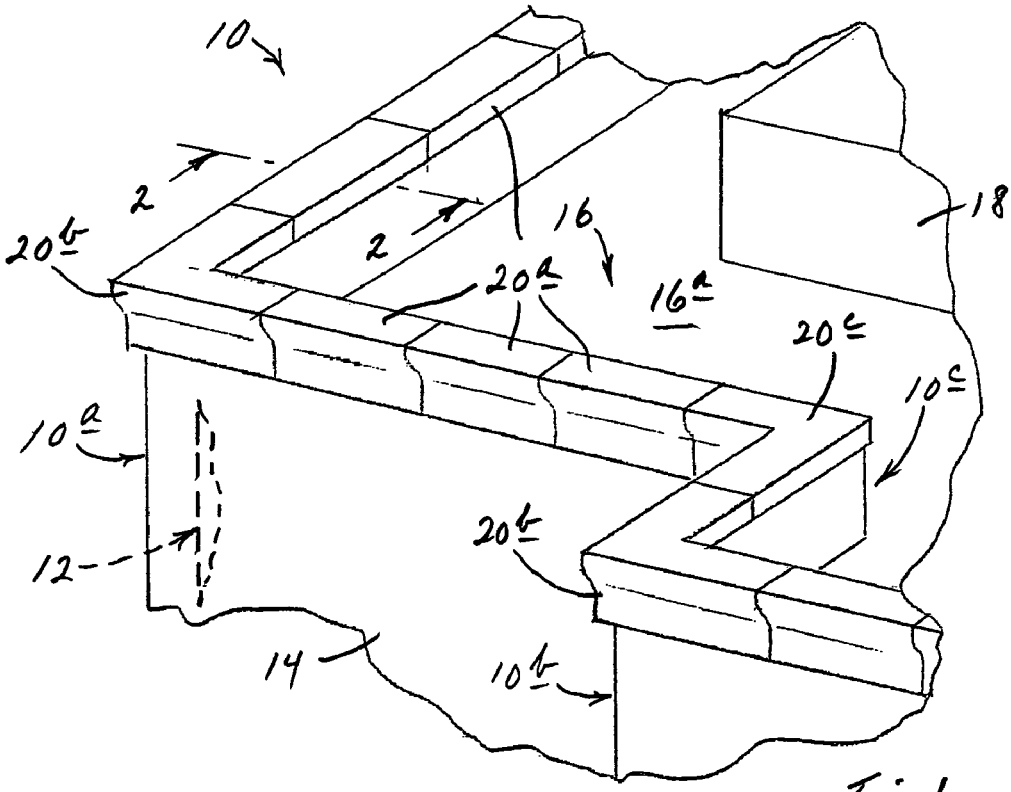
FIG. 1 is a fragmentary, simplified, isometric view of a corner region in a plural-story building illustrating both inside and outside corner structure features, with respect to which modular parapet structure made in accordance with the present invention is shown to be in place. Several parapet units, both linear and angular, are shown in this figure.
Figure 2:
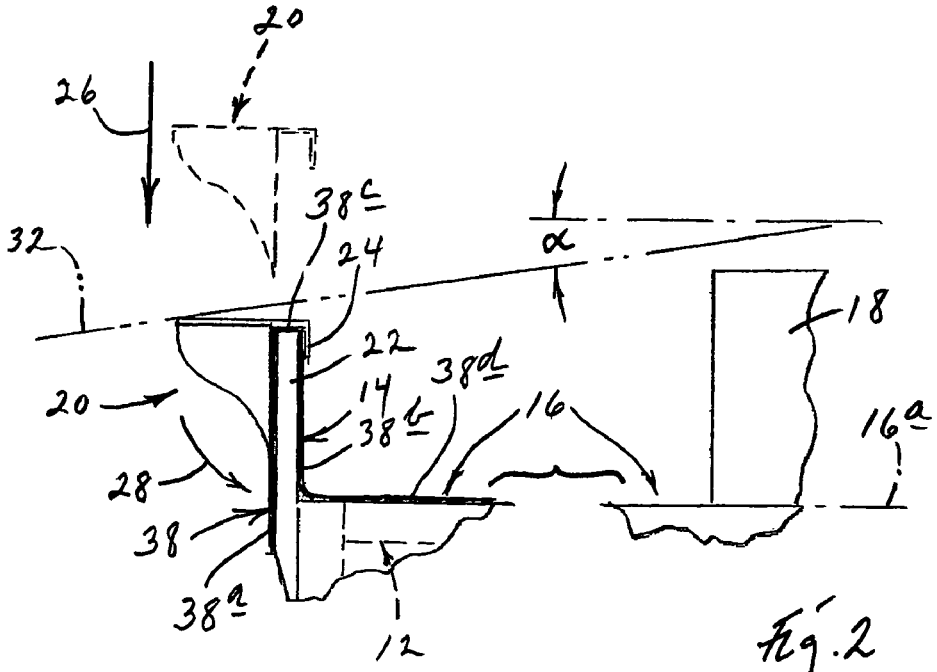
FIG. 2 is a somewhat enlarged, simplified, schematic and fragmentary view, taken generally as if along line 2-2 in FIG. 1, illustrating, in very general terms, how a representative parapet unit made in accordance with practice of the present invention may be gravity hung and stabilized, and if desired releasably locked in place, on what is referred to herein as docking structure which is provided adjacent the edge-defining perimeter, or rim, of the plane of the roof structure provided by the frame of the building structure shown in FIG. 1.

Turning now to the drawings, and referring first of all to FIGS. 1 and 2, indicated generally at 10 is a plural-story building including an internal frame, or frame structure, 12 on the outside of which is mounted a suitable surfacing structure 14. Specifically shown in FIG. 1 is what can be thought of as being an outside corner portion, or region, of building 12, including a pair of outside corners 10*a*, 10*b* which are defined by angles of about 270-degrees, and an inside corner 10*c* which is defined by angle of about 90-degrees.

While frame 12 and surfacing structure 14 can, as will become apparent, take a number of different forms, the specifics of which forms constitute no part of the present invention, for the purpose of description and illustration herein, building frame 12 has been built in accordance with the teachings of U.S. Pat. No. 6,837,016 B2 which illustrates and describes a plural-story, moment-frame structure, and surfacing structure 14 takes the form of the surfacing structure described in currently pending U.S. patent application Ser. No. 10/818,014, filed Apr. 5, 2004 for "Matrix Frame/Panel Skin Building Structure".

Defined by the upper portion of frame structure 12 is roof structure 16 which, in building 10, is defined by what is referred to herein as a perimeter-rimmed, or edge-rimmed, upper surface, or plane, 16*a*. Illustrated at 18 in FIGS. 1 and 2 is a fragmentary portion of roof-mounted building equipment structure, such as air conditioning structure, which is disposed inwardly from the perimeter of roof structure 16.

In accordance with practice of the present invention, the elongate edges, or perimeter stretches, of roof structure 16 are provided with changeable and selectively reconfigurable, modular, parapet roof-rim structure, or roof-rim parapet structure, 20, constructed in accordance with the present invention. Parapet structure 20 herein includes plural modular units, such as straight and linear units 20*a*, outside corner units, such as units 20*b*, and inside corner units (where required) such as single inside corner unit 20*c*.

Figure 3:
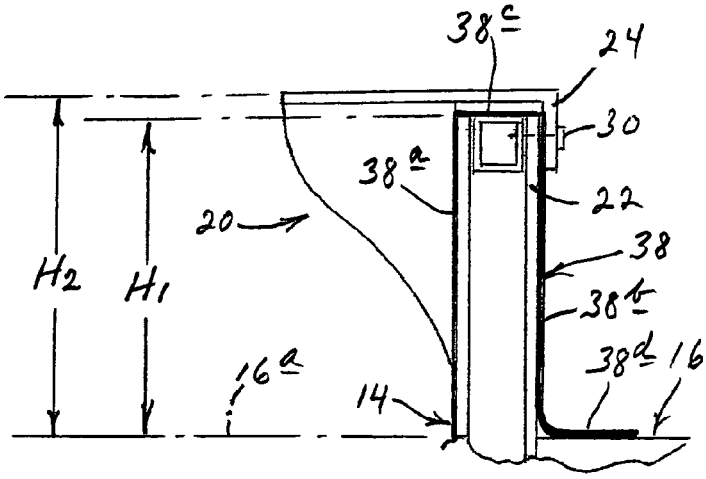
FIG. 3 provides a somewhat more detailed view, like that presented by a portion of FIG. 2, illustrating one representative set of forms of gravity-docking reception structure and gravity-docking structure employed in accordance with the modular parapet structure of the present invention, illustrated in essentially the same settings pictured in FIGS. 1 and 2.

Adding reference now to FIG. 3 along with FIGS. 1 and 2, the units in parapet structure 20 have been designed with predetermined cross-sectional configurations, such as the configuration generally shown in FIGS. 1, 2 and 3—a configuration which has been purposely designed to provide building 10 with a roof-rimming parapet structure of having a selected, pleasing ornamental design. As will become apparent, an interesting and important feature of the invention is that the structure and practice of this invention allow for essentially any appropriate, selectable cross-sectional ornamental configuration, and thus permit a building's roof rim structure to be decorated with a variety of different designable looks. Moreover, and as will also become apparent, the fact of constructing a building, such as building 10, with a given design for a parapet structure constructed in accordance with the invention, does not prevent this look from being changed at a later date if so desired simply by removing the removably mounted parapet units of one design and replacing them with appropriate modular units of another design.

Included in parapet structure 20 is what is referred to herein as a gravity-lock engageable, gravity-docking reception structure, riser structure, or vertically protruding lip 22 which is suitably joined to building frame 12 as a structure effectively distributed along the rim of roof structure 16. Structure 22 rises by a selectable, appropriate elevation $H_1$ above plane 16*a*. In the specific embodiment of the invention which is now being described, the upper end of this riser structure has, as can be seen, a somewhat inverted, U-shaped, cross-sectional configuration which is intended, as will be explained, dockably to receive complementary, external gravity-docking structure (also referred to as complementary structure) which is provided on the inner sides of parapet units, or components, 20*a*, 20*b*, 20*c*. Those skilled in the art will recognize that gravity-docking reception structure 22 can be shaped in various different ways, can be placed at different selected elevations effectively above the plane of a roof top, such as plane 16*a*, and may be suitably integrated with a building surfacing structure, or with the framework for such a surfacing structure, such as surfacing structure 14. In the illustration provided in FIGS. 2 and 3, integration with surfacing structure 14 is what is specifically shown.

The earlier-mentioned docking structure which, of course, is external to structure 22, and which is also referred to herein as gravity-docking structure, and as hook structure, has the illustrated, generally inverted U-shaped hooklike configuration which enables it to be lowered and gravity caught and locked on structure 22. This hook structure is shown generally at 24 in FIGS. 2 and 3.

It will be evident that the specific structural configurations for riser structure 22 and hook structure 24 may take on a host of different configurations depending upon designer choice. What is important is that the riser structure and the hook structure be configured so that the parapet units of the invention can be gravity-impelled lowered, as illustrated by arrow 26 in FIG. 2, to cause the hook structure to "dock" with the upper end of the riser structure at the appropriate lateral location along the building roof rim, whereby the different parapet units become, automatically, properly seated and gravity locked in a condition (vertical arrangement/fit) with the relevant hook structures appropriately docked with the riser structure. Preferably, the riser structure and the hook structure of this invention are configured in such a fashion that when docking occurs, there a tendency for the relevant parapet unit to experience inwardly and downwardly directed vectors which produce an angular moment as illustrated by arrow 28 in FIG. 2. This moment causes the associated parapet unit to seat in an appropriate disposition relative to the associated building structure. This characteristic of the parapet structure of this invention is referred to herein as a self-locating interaction characteristic.

Preferably, once a parapet unit has been appropriately docked in place, so-to-speak, it is then anchored against inadvertent movement by an appropriate removable locking structure, such as a bolting structure like that shown generally at 30 in FIG. 3.

As can be seen, the parapet structure so far described is one which offers basically all of the features and advantages that are considered (as expressed earlier herein) to be interesting and important in a building parapet structure. This parapet structure may take on a number of different shapes and forms to provide a selected, decorative outside rimming appearance for the roof rim structure in a building. The proposed modular parapet structure can easily and quickly, and without complexity, be lowered, self-positioned, and gravity-seat stabilized and locked in position, as determined by the dockingly interengaged gravity-docking reception structure and the gravity-docking structure. The specific sizes with are employed in a particular building construction are clearly a matter of designer choice. Preferably, the interactive reception and gravity-docking structures are designed whereby, with the parapet roof-rim structure in place, it rises sufficiently above the roof elevation (see $H_2$ in FIG. 3), not only to provide a personnel protective barrier (a rim wall), around the perimeter of a roof structure, but also to furnish visual occlusion below a certain, shallow angle below the horizontal, such as angle a pictured in FIG. 2, of rooftop building equipment structure, such as structure 18. Dash-double-dot line 32 in FIG. 2 illustrates this occluding capability of the structure of this invention relative to a finally positioned parapet unit 20*a* which is shown seated in a finally established position in dashed lines in FIG. 2.

Figure 4:
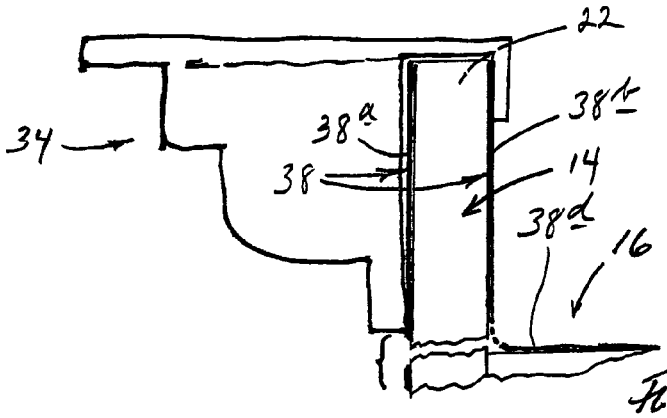
FIGS. 4 and 5 are similar to FIG. 3, except that, on a slightly larger scale, they illustrate two, different, outwardly appearing ornamental, roof-rimming configurations for the body of a modular parapet unit made in accordance with practice of the present invention.
Figure 5:
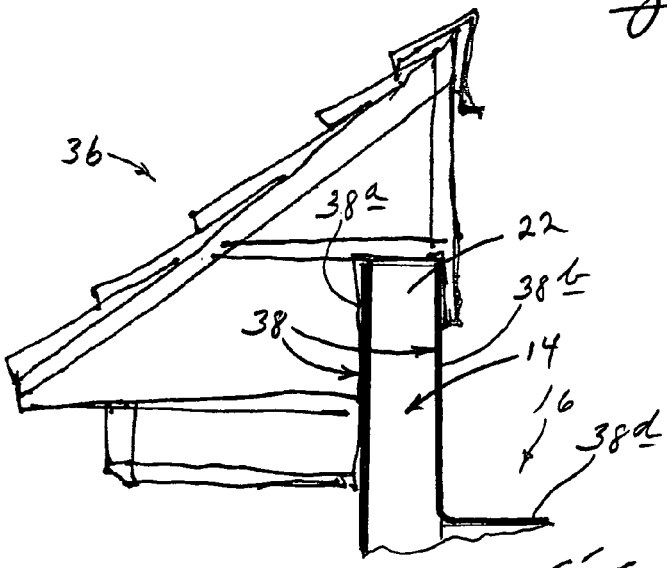

As has been mentioned herein, the parapet structure of this invention offers the opportunity for wide ranging designing and installation use of different, ornamental parapet configurations, and two, additional such configurations are shown at 34, 36 in FIGS. 4 and 5, respectively, in drawings to illustrate this import characteristic of the invention.

Another selectively useable feature of the invention, employable in certain modifications thereof, involves using the basic interconnecting components of the parapet roof-rim structure of the invention to lock between them expanses of sheet-like moisture-barriering flashing structure. Heavy, darkened lines 38 in FIGS. 2-5, inclusive, show such a flashing structure.

In FIGS. 2 and 3, flashing structure 38 includes outer and inner expanses 38*a*, 38*b* which lie adjacent the outer and inner sides (the left and right sides, respectively, in these figures) of gravity-docking reception structure 22, and a connector expanse 38*c* which joins expanses 38*a*, 38*b* where it extends laterally over the top of structure 22.

In FIGS. 4 and 5, flashing structure 38 does not include connector expanse 38*c*.

In all four of these figures, inner flashing-structure expanse 38*b* extends downwardly along the inner side of structure 22, and as a continuum laterally inwardly in an expanse 38*d* which substantially directly overlies the plane of building roof structure 16.

Obviously, the materials employed in the implementation of this invention are a matter of designer choice, as are the sizes of parapet units, the configurations of such units, and the specific configurations of the hook and riser structures which interact to promote gravity seating and locking of a parapet unit in place. Also, it will be clear that the proposed parapet roof-rim structure of this invention readily lends itself to various kinds of cooperative incorporation in a wide variety of building roof rim structures.

Accordingly, while a preferred embodiment, and certain variations thereof, have been described herein for the parapet structure of this invention, other variations and modifications, some of which have been generally suggested, are clearly possible, and are considered to come within the scope of the claims and spirit of this invention.

We claim:

1. Gravity-stabilized modular and selectively unit-changeable and reconfigurable, parapet roof-rim structure comprising prepared, roof-rim gravity-docking reception structure disposed along and adjacent an elongate side of a building roof-structure perimeter, and constructed and arranged to receive and hold by gravity external structure which is lowered toward the reception structure, and modular, external parapet unit structure formed with plural, independent, modular parapet units, including angular corner units and linear non-corner units, constructed and arranged for complementary gravity docking with said reception structure, said units being lowerable by gravity in side-by-side unit adjacency toward conditions of unit-removable, gravity-stabilized disposition with respect to said reception structure, thus to form, collectively, a parapet roof rim along said roof-structure perimeter, said parapet roof rim including plural linear non-corner units disposed between pairs of angular corner units, and accommodating selective individual unit removal and replacement, thus to change the effective overall appearance of the parapet unit structure, wherein each external parapet unit structure includes a hook structure extending from an upper margin thereof for engaging said roof-rim gravity-docking reception structure and which further includes a locking structure extending through said hook structure and into said roof-rim gravity-docking reception structure, wherein said locking structure is thread-anchored in said roof-rim gravity-docking reception structure.

2. The roof-rim structure of claim 1, wherein said reception and gravity-docking structures are constructed and arranged for self-gravity-locking interaction.

3. The roof-rim structure of claim 1, wherein said reception and gravity-docking structures are constructed and arranged whereby gravity docking involves a moment having downwardly and inwardly directed vectors disposed outwardly of said perimeter.

4. The roof-rim structure of claim 1 which is intended for use with a building roof having a defined roof elevation, and which supports upwardly extending building-equipment structure which extends a certain distance above the mentioned defined elevation, and said reception and gravity-docking structures are sized whereby, when they are dockingly interengaged, the overall parapet roof-rim structure occludes lateral viewing of such building-equipment structure below a predetermined angle of lateral view relative to the vertical.

5. The roof-rim structure of claim 1, wherein, interposed said gravity-docking reception structure and said gravity-docking structure is sheet-like, roof-rim, moisture-barriering flashing structure which, with said roof-rim structure in place, becomes locked in place between the gravity-docking reception structure and the gravity-docking structure, wherein said locking structure passes therethrough.

6. The roof-rim structure of claim 5, wherein the building roof has a defined roof elevation, and said flashing structure includes an expanse which extends as a continuum downwardly along said gravity-docking reception structure, and laterally inwardly over at least a portion of the building roof substantially at the mentioned roof elevation.

7. The roof-rim structure of claim 5, wherein said gravity-docking reception structure has inner and outer sides, and said flashing structure includes inner and outer expanses disposed adjacent said gravity-docking reception structure's said inner and outer sides, respectively.

8. The roof-rim structure of claim 7, wherein said gravity-docking reception structure has a top, and said flashing structure includes a connector expanse which joins the flashing structure's inner and outer expanses at a location which extends over the gravity-docking structure's top.

9. A parapet structure for use on a multi-story building comprising a riser structure extending above a perimeter roof level of the multi-story building configured to receive and hold, by gravity, the parapet structure thereon, an external parapet unit structure comprising modular parapet units, including angular corner units and linear, non-corner units, configured for complementary gravity docking with said riser structure, said parapet units being lowerable by gravity in side-by-side unit adjacency toward conditions of unit-removable, gravity-stabilized disposition with respect to said riser structure, thus to form, collectively, a parapet roof rim along said roof-structure perimeter, said parapet roof rim including plural linear non-corner units disposed between pairs of angular corner units, accommodating selective individual unit removal and replacement, thus to change the effective overall appearance of the parapet unit structure, a hook structure formed on each of said parapet unit structures for engaging an underlying riser structure, and a locking structure which extends through said hook structure to engage the underlying riser structure to secure said parapet unit structure to said riser structure.

10. The parapet structure of claim 1, wherein said riser structure and said parapet unit structure are configured whereby gravity docking involves a moment having downwardly and inwardly directed vectors disposed outwardly of said perimeter.

* * * * *